United States Patent [19]

Kwak

[11] Patent Number: 4,760,642

[45] Date of Patent: Aug. 2, 1988

[54] DEVICE FOR RAZOR AND TOOTHBRUSH CONTAINING SHAVING CREAM DISPENSERS THEREIN

[76] Inventor: Kyu H. Kwak, 11308 Grandview Ave., Wheaton, Md. 20902

[21] Appl. No.: 43,357

[22] Filed: Apr. 28, 1987

[51] Int. Cl.[4] ..... B26B 21/44; A45D 40/00

[52] U.S. Cl. ..... 30/123; 30/41; 30/86; 132/80 R; 132/84 R

[58] Field of Search ..... 30/41, 86, 123; 132/80 R, 80 B, 84 R, 84 D, 79 B; 401/135, 150, 154, 288

[56] References Cited

U.S. PATENT DOCUMENTS

| | | | |
|---|---|---|---|
| 1,574,610 | 2/1926 | Delaney | 132/80 R X |
| 3,549,268 | 12/1970 | Casselman | 401/154 |
| 4,056,110 | 11/1977 | Landsman | 132/84 R |
| 4,542,828 | 9/1985 | Gotto | 30/41 X |
| 4,635,361 | 1/1987 | DeMars | 30/41 |
| 4,653,188 | 3/1987 | Kwak | 30/86 X |

*Primary Examiner*—E. R. Kazenske
*Assistant Examiner*—Michael D. Folkerts
*Attorney, Agent, or Firm*—Birch, Stewart, Kolasch & Birch

[57] ABSTRACT

A razor and toothbrush assembly comprises a body member having chambers disposed therein and handles slidably disposed thereon, the chambers containing shaving cream and toothpaste dispensers disposed therein whereby shaving cream and toothpaste disposed in the shaving cream and toothpaste dispensers are dispensed from the shaving cream and toothpaste dispensers by pressing the handles against the shaving cream and toothpaste dispensers, respectively.

8 Claims, 2 Drawing Sheets

10
11
12
13
14
15
16
17
18
20
21
22
24
28
29
30
31
32
33
35
36
37
38
39

DEVICE FOR RAZOR AND TOOTHBRUSH CONTAINING SHAVING CREAM DISPENSERS THEREIN

BACKGROUND OF THE INVENTION

The present invention relates to a device for a razor and a toothbrush containing a shaving cream and a separate toothpaste dispensers therein. And the present invention more particularly, relates to an improved razor and toothbrush assembly enclosing a flexible shaving cream and a separate toothpaste dispensers whereby when shaving of the shaving area and cleaning of the teeth, the shaving cream and toothpaste are caused to flow from the shaving cream and toothpaste dispensers to the mouth of the razor and the plurality of bristles of the toothbrush by pressing a handle against the dispensers, respectively.

There are many types of razors or toothbrushes which are well known in the prior art which utilize the use of a shaving cream dispenser or a toothpaste dispenser therein, separately. For example, U.S. Pat. No. 4,653,188 owned by the present applicant discloses a razor containing a shaving cream dispenser therein. However, it is inconvenient for a traveler, tourist or the like to carry a razor device as well as toothbrush with toothpaste. Also, U.S. Pat. No. 3,879,139 discloses a disposable toothbrush assembly with toothpaste encased within the base of a head for permitting ready extrusion when use is desired. However, the toothpaste can be flowed from a toothpaste slug to a plurality of bristles through only one opening so that the flowed toothpaste does not spread on a plurality of chimney thereof. Furthermore, the patent does not disclose to associate with a razor enclosing a shaving cream disposed therein so that it is not convenient to carry them by traveler or tourist.

OBJECTS AND SUMMARY OF THE INVENTION

Accordingly, it is an object of the present invention to provide a razor and toothbrush assembly containing shaving cream and separate toothpaste disposed therein.

Another object of the present invention is to provide an improved device for a razor and toothbrush containing a shaving cream and toothpaste dispensers disposed therein, respectively, which are changeable.

A further object of the present invention is to provide a device for a razor and toothbrush enclosing a shaving cream and separate toothpaste dispensers disposed therein whereby when the razor and toothbrush are operated, the shaving cream and toothpaste are caused to immediately flow to the head of them by pressing handles provided on the device, respectively.

The present invention relates to a razor and toothbrush assembly which comprises a body member having chambers disposed therein and handles slidably disposed thereon, the chambers containing shaving cream and toothpaste dispensers disposed therein whereby shaving cream and toothpaste disposed in the shaving cream and toothpaste dispensers are dispensed from the shaving cream and toothpaste dispensers by pressing the handles against the shaving cream and toothpaste dispensers, respectively.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
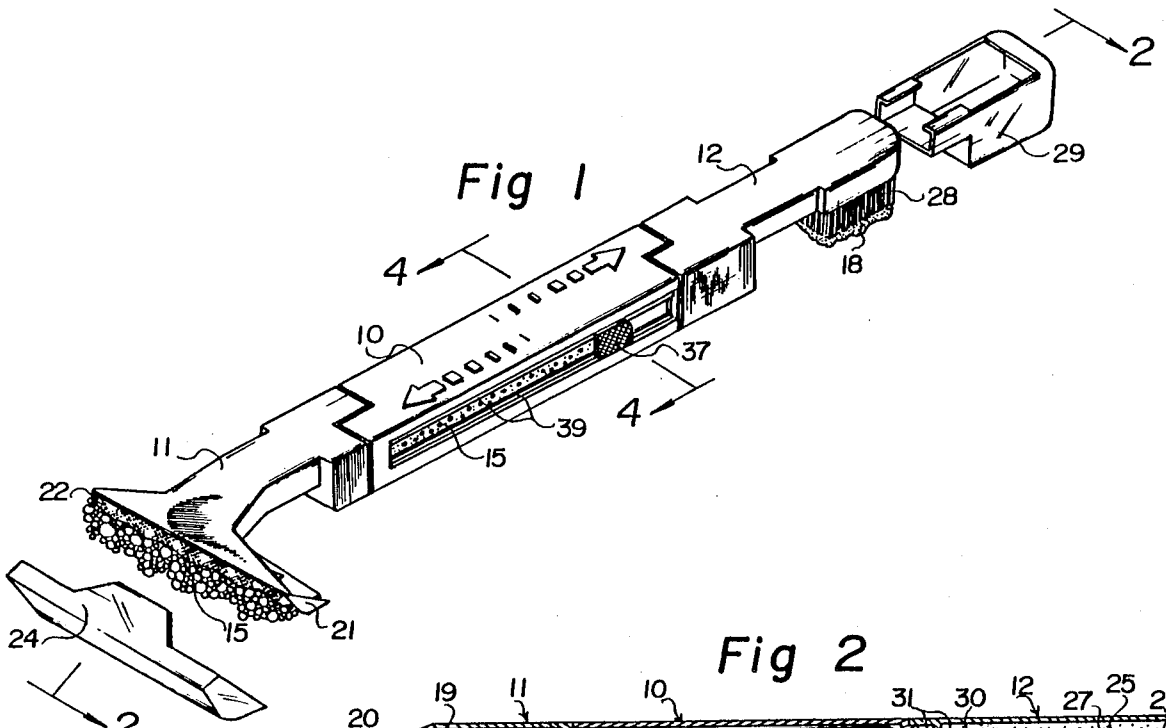
FIG. 1 is a perspective view of the razor and toothbrush assembly of the present invention.
Figure 2:
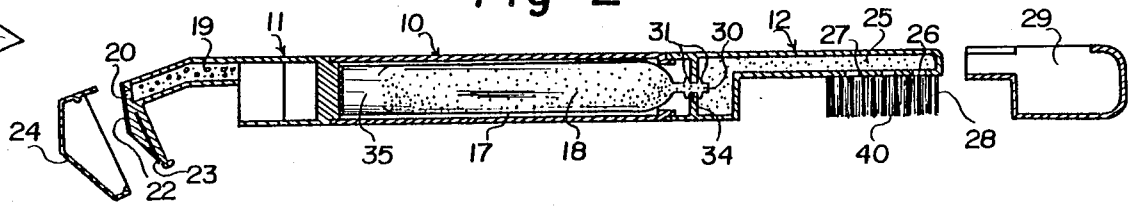
FIG. 2 is a cross-sectional view of FIG. 1, taken along line 2—2.
Figures 3, 4:
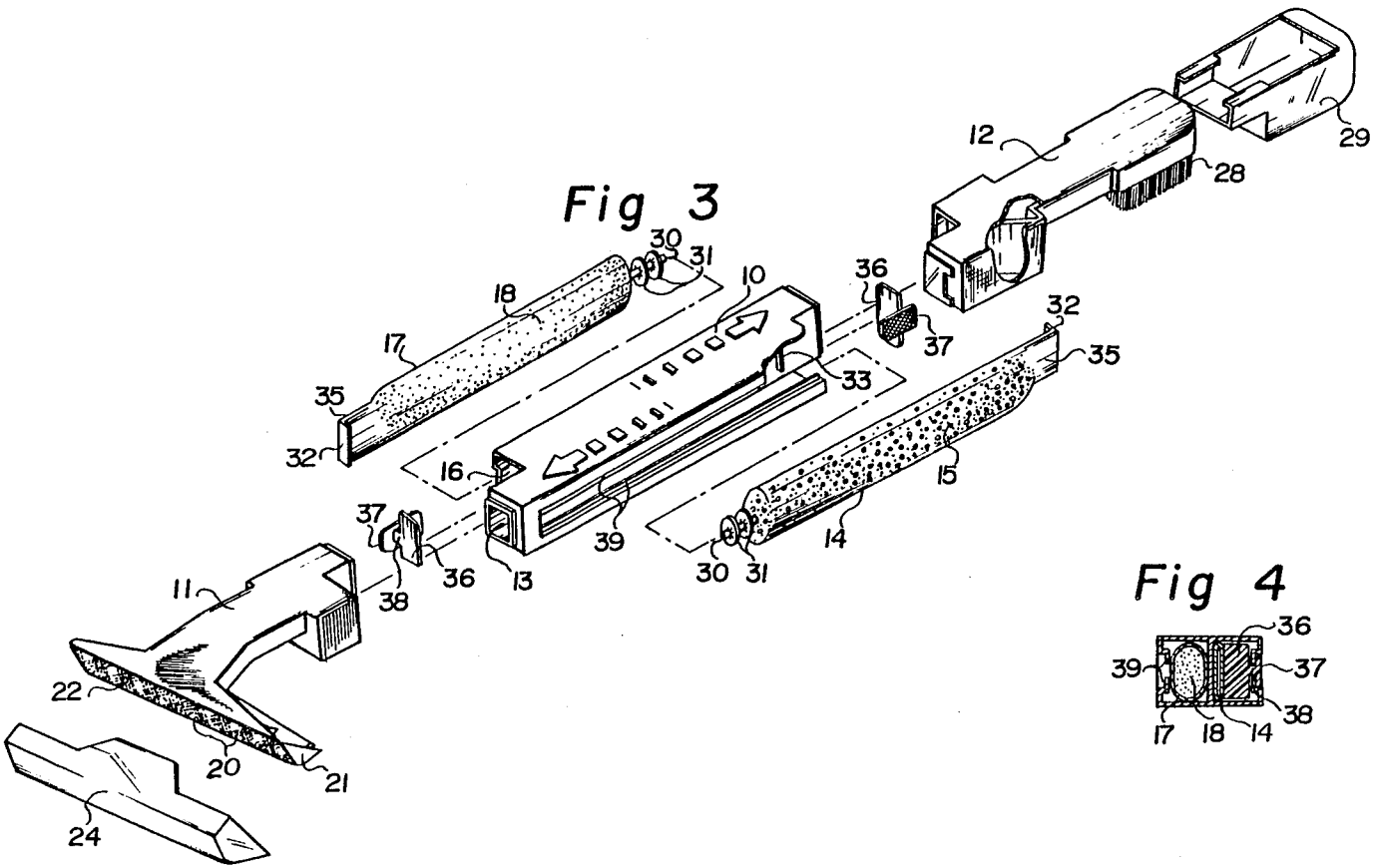
FIG. 3 is an exploded view of the razor and toothbrush assembly of the present invention.
FIG. 4 is a cross-sectional view of FIG. 1, taken along line 4—4.

Referring now in detail to the drawings for the purpose of illustrating the present invention, the razor and toothbrush assembly containing a shaving cream and a toothpaste dispensers disposed therein, respectively as shown in FIGS. 1, 2 and 3 comprises a main body member 10, a T-shaped razor member 11 disposed at one end of the main body member 10 and a T-shaped toothbrush member 12 disposed at the other end thereof. The main body member 10 is provided with a first chamber 13 for housing a shaving cream dispenser 14 containing shaving cream 15 therein. Also, the main body member 10 is provided with a second chamber 16 for housing a toothpaste dispenser 17 containing toothpaste 18. The dispenser 14 for shaving cream 15 and dispenser 17 for toothpaste 18 therein, respectively, are made of flexible materials such as rubbers or plastics.

The T-shaped razor member 11 is provided with a razor head chamber 19 containing the shaving cream 15 from the shaving cream dispenser 14 through a plurality of small holes 20 disposed at the front side of a razor head 21 to a cotton surface plate 22. A blade 23 extends along the side of the razor head 21 as shown in FIG. 2. A removable razor cap 24 disposed at the end of the T-shaped razor member 11 can be attached thereto or detached therefrom for improving the safety.

As shown in FIG. 2, the T-shaped toothbrush member 12 is provided with a toothbrush head chamber 25 containing the toothpaste 18 from the toothpaste dispenser 17 through a plurality of small holes 26 disposed at a head wall 27 to a plurality of bristles 28. A removable toothbrush cap 30 disposed at the end of the T-shaped tooth member 12 can be attached thereto or detached therefrom for preventing the toothbrush from contaminating. As shown in FIGS. 2 and 3, the dispensers 14 and 17 have an outlet tube 30 disposed at one end thereof and a hook-like member 32 disposed at the other end thereof to engage a raised portion 33 located on the inside of the first and second chambers 13 and 16, respectively. The outlet tube 30 includes a pair of stop members 31 which engage both side of a hole 34 positioned in a partition which separates the first and second chambers 13 and 16 from the razor and toothbrush head chambers 19 and 25, respectively. Also, the dispensers 14 and 17 are provided with a rear flat portion 35 which enables a pressing plate 36 attached to a handle member 37 to be applied against the rear of the dispensers 14 and 17, respectively (FIG. 4). The handle member 37 is connected to the pressing plate 36 by a connecting member 38. The connecting member 38 is moved between parallel rubber gaskets 39 disposed at both sides of the main body member 10. Thus, the shaving cream 15 and toothpaste 18 can be dispersed from the dispensers 14 and 17 by pushing the handle members 37 along the parallel gaskets 39 of both sides of the main body member 10, respectively. There are spaces disposed between the parallel rubber gaskets disposed for indicating the amount of the shaving cream 15 and toothpaste 18 available in the dispensers 14 and 17, respectively.

In operation, after removing the razor and toothbrush caps 24 and 29 and the handle members 37 from the device of the present invention, the shaving cream and toothpaste dispensers 14 and 17 containing the shaving cream 15 and toothpaste 18, respectively, are placed in the first and second chambers 13 and 16 of the main body member 10, respectively. After attaching the removal caps 24 and 29 and handle members 37 to the main body member 10, the shaving cream 15 and toothpaste 18 are dispensed by pressing the handle members 37 which squeeze the dispensers 14 and 17 causing the shaving cream 15 and toothpaste 18 to flow from the dispensers 14 and 17 to the cotton surface plate 22 through the razor head chamber 19, and to the plurality of bristles 28 through the toothbrush head chamber 25, respectively. Since the shaving cream and toothpaste dispensers 15 and 17 are secured to the main body member 10, respectively, by the stop members 31 secured on both sides of the holes 34 and the hook member 32 are engaged with the raised portion 33 disposed on the insides of the first and second chambers 13 and 16, respectively, the shaving cream and toothpaste dispensers 15 and 17 do not move during the squeezing of the dispensers by the handle members 37, respectively. Furthermore, the shaving cream 15 and toothpaste 18 which are passed through the plurality of the small holes 20 and 26 are uniformly distributed through numerous small apertures of the cotton surfaces 22 and a plurality of chimneys 40, respectively, so that it is easy to use the shaving and cleaning device of the present invention.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A razor and toothbrush assembly containing a shaving cream and toothpaste dispensers therein, respectively, which comprises:

a main body member containing first and second chambers, said shaving cream dispenser disposed in said first chamber and said toothpaste dispenser disposed in said second chamber, a razor member containing a razor head chamber communicating with said first chamber and an outlet of the shaving cream dispenser disposed therein, a toothbrush member containing a toothbrush head chamber communicating with said second chamber and an outlet of the toothpaste dispenser disposed therein, said shaving cream dispenser and said toothpaste dispenser containing stop members at one end thereof for providing a fixed communication between said respective dispensers and said respective head chambers, handle means slidably disposed along the side of the first and second chambers of the main body member, said handle means extending into said first and second chambers, whereby the shaving cream and toothpaste are dispersed from the shaving cream and toothpaste dispensers through the head chambers by pressing the handle means against the shaving cream and toothpaste dispensers, respectively.

2. The razor and toothbrush assembly of claim 1 wherein the razor member is provided with a razor head member which contains a plurality of holes disposed on one side thereof, said razor head member being provided with a cotton surface plate for uniformly distributing the shaving cream to a shaving area.

3. The razor and toothbrush assembly of claim 1 wherein the toothbrush member is provided with a toothbrush head member which contains a plurality of holes disposed on a head wall for uniformly distributing the toothpaste to a plurality of chimneys.

4. The razor and toothbrush assembly of claim 1 wherein the shaving cream dispenser includes a flat portion and a hook member engaging a raised portion disposed on the inside of the first chamber of the main body member.

5. The razor and toothbrush assembly of claim 1 wherein the toothpaste dispenser includes a flat portion and a hook member engaging a raised portion disposed on the inside of the second chamber of the main body member.

6. The razor and toothbrush assembly of claim 1 wherein the shaving cream dispenser is made of a flexible material.

7. The razor and toothbrush assembly of claim 1 wherein the toothpaste dispenser is made of a flexible material.

8. The razor and toothbrush assembly of claim 1 wherein the main body member is provided with spaced-apart gaskets disposed at both sides thereof for extending the handle means therethrough.

* * * * *